US009181023B2

(12) United States Patent
Clinton

(10) Patent No.: US 9,181,023 B2
(45) Date of Patent: Nov. 10, 2015

(54) CONTAINER ASSEMBLY

(71) Applicant: So Y. Clinton, Las Vegas, NV (US)

(72) Inventor: So Y. Clinton, Las Vegas, NV (US)

( * ) Notice: Subject to any disclaimer, the term of this patent is extended or adjusted under 35 U.S.C. 154(b) by 419 days.

(21) Appl. No.: 13/849,481

(22) Filed: Mar. 23, 2013

(65) Prior Publication Data

US 2014/0284238 A1 Sep. 25, 2014

(51) Int. Cl.

| | |
|---|---|
| ***B65D 85/60*** | (2006.01) |
| ***H04R 1/02*** | (2006.01) |
| ***B65D 81/36*** | (2006.01) |

(52) U.S. Cl.

CPC ..... *B65D 85/60* (2013.01); *B65D 81/365* (2013.01); *H04R 1/028* (2013.01); *B65D 2203/12* (2013.01)

(58) Field of Classification Search

CPC .. B65D 85/60; B65D 81/365; B65D 2203/12; H04R 1/028

USPC ..... 206/37–39, 457, 459.1; 116/200, 216; 340/5.2, 384.1, 517, 568.1, 568.8

See application file for complete search history.

(56) References Cited

U.S. PATENT DOCUMENTS

| | | | | |
|---|---|---|---|---|
| 6,707,381 | B1 * | 3/2004 | Maloney | 340/568.1 |
| 8,138,690 | B2 * | 3/2012 | Chemel et al. | 340/517 |
| 2002/0105431 | A1 * | 8/2002 | McNeese et al. | 340/384.1 |
| 2006/0060488 | A1 * | 3/2006 | Rodriguez | 206/457 |
| 2007/0146153 | A1 * | 6/2007 | LaFleur et al. | 340/686.1 |
| 2008/0156690 | A1 * | 7/2008 | Landau et al. | 206/723 |
| 2009/0128330 | A1 * | 5/2009 | Monroe | 340/568.1 |
| 2014/0190858 | A1 * | 7/2014 | Schramm | 206/457 |

* cited by examiner

*Primary Examiner* — Luan K Bui

(57) ABSTRACT

A container assembly includes sensors to detect events that occur in proximity to the container including thermal energy changes, light variances, and movement. For example, an item placed in or removed from an open end of the container, movement of the container, and shadows that pass over an open end of the container. The sensors detect the event then transmit a signal to a measuring or control instrument to trigger a predetermined illumination and/or audio signal. The sensors embed in a base portion of the container, operatively joining with a processor. Sensors include photocells for light, passive infra-red for temperature, and omni-directional sensors for movement. In this manner, movement, changes in temperature and light cause an illumination portion to emit light, and an audio portion to emit an audio signal to provide animation and safety features for the container.

20 Claims, 8 Drawing Sheets

CONTAINER ASSEMBLY

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to containers. More particularly, one or more embodiments of the invention relate to events that trigger actions in container assemblies.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a basket is a container which is traditionally constructed from stiff fibers, which can be made from a range of materials, including wood splints, runners, and cane. Baskets are generally woven by hand. Some baskets are fitted with a lid, others are left open.

Typically, Halloween is a yearly celebration observed by many people on October 31$^{st}$. Common festive Halloween activities include, without limitation, dressing up in costumes, trick-or-treating, attending costume parties, carving pumpkins into jack-o'-lanterns, lighting bonfires, and telling scary stories.

Typically, a sensor is a device which receives and responds to a signal when touched. A sensor's sensitivity indicates how much the sensor's output changes when the measured quantity changes. There are numerous types of sensors that can trigger lights and sound by carrying a load through an integrated circuit.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 7A illustrates a front side of an exemplary processor portion, and FIG. 7B illustrates a back side of an exemplary processor portion with an exemplary audio power switch, in accordance with an embodiment of the present invention.

Figure 1:
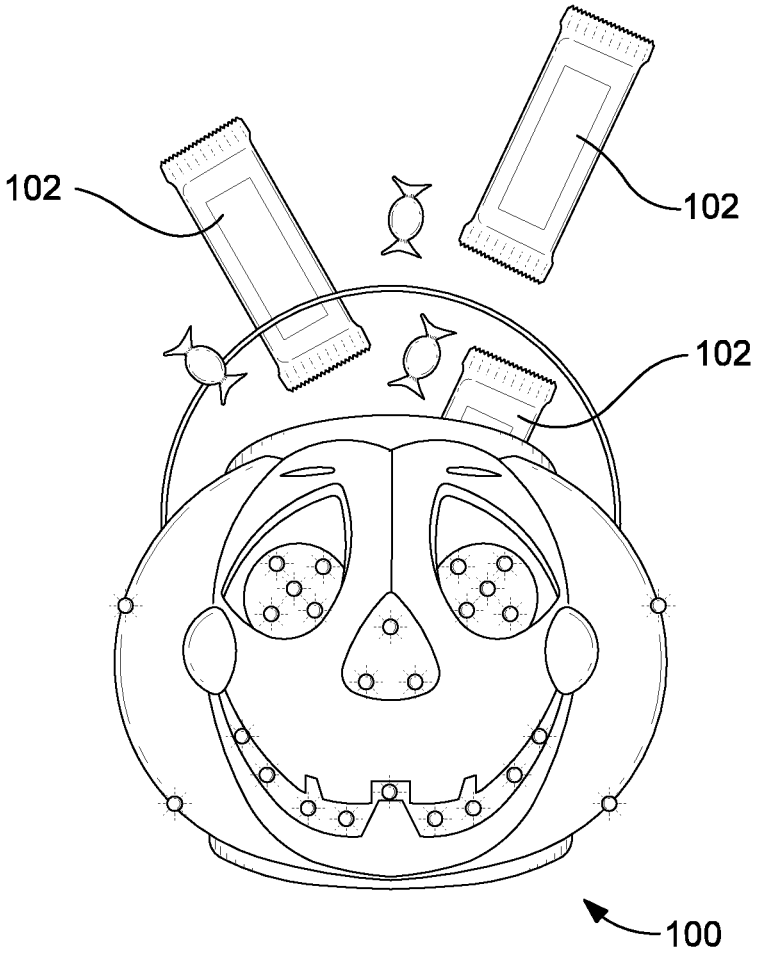
FIG. 1 illustrates a detailed perspective view of an exemplary container assembly containing at least one item, in accordance with an embodiment of the present invention.

Unless otherwise indicated illustrations in the figures are not necessarily drawn to scale.

DETAILED DESCRIPTION OF SOME EMBODIMENTS

Embodiments of the present invention are best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present application or of any further application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation of any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

A "computer" may refer to one or more apparatus and/or one or more systems that are capable of accepting a structured input, processing the structured input according to prescribed rules, and producing results of the processing as output. Examples of a computer may include: a computer; a stationary and/or portable computer; a computer having a single processor, multiple processors, or multi-core processors, which may operate in parallel and/or not in parallel; a general purpose computer; a supercomputer; a mainframe; a super mini-computer; a mini-computer; a workstation; a microcomputer; a server; a client; an interactive television; a web appliance; a telecommunications device with internet access; a hybrid combination of a computer and an interactive television; a portable computer; a tablet personal computer (PC); a personal digital assistant (PDA); a portable telephone; application-specific hardware to emulate a computer and/or software, such as, for example, a digital signal processor (DSP), a field-programmable gate array (FPGA), an application specific integrated circuit (ASIC), an application specific instruction-set processor (ASIP), a chip, chips, a system on a chip, or a chip set; a data acquisition device; an optical computer; a quantum computer; a biological computer; and generally, an apparatus that may accept data, process data according to one or more stored software programs, generate results, and typically include input, output, storage, arithmetic, logic, and control units.

Those of skill in the art will appreciate that where appropriate, some embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Where appropriate, embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

"Software" may refer to prescribed rules to operate a computer. Examples of software may include: code segments in one or more computer-readable languages; graphical and or/textual instructions; applets; pre-compiled code; interpreted code; compiled code; and computer programs.

The example embodiments described herein can be implemented in an operating environment comprising computer-executable instructions (e.g., software) installed on a computer, in hardware, or in a combination of software and hardware. The computer-executable instructions can be written in a computer programming language or can be embodied in firmware logic. If written in a programming language conforming to a recognized standard, such instructions can be executed on a variety of hardware platforms and for interfaces to a variety of operating systems. Although not limited thereto, computer software program code for carrying out operations for aspects of the present invention can be written in any combination of one or more suitable programming languages, including an object oriented programming languages and/or conventional procedural programming languages, and/or programming languages such as, for example, Hyper text Markup Language (HTML), Dynamic HTML, Extensible Markup Language (XML), Extensible Stylesheet Language (XSL), Document Style Semantics and Specification Language (DSSSL), Cascading Style Sheets (CSS), Synchronized Multimedia Integration Language (SMIL), Wireless Markup Language (WML), Java™, Jini™, C, C++, Smalltalk, Peri, UNIX Shell, Visual Basic or Visual Basic Script, Virtual Reality Markup Language (VRML), ColdFusion™ or other compilers, assemblers, interpreters or other computer languages or platforms.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

A network is a collection of links and nodes (e.g., multiple computers and/or other devices connected together) arranged so that information may be passed from one part of the network to another over multiple links and through various nodes. Examples of networks include the Internet, the public switched telephone network, the global Telex network, computer networks (e.g., an intranet, an extranet, a local-area network, or a wide-area network), wired networks, and wireless networks.

The Internet is a worldwide network of computers and computer networks arranged to allow the easy and robust exchange of information between computer users. Hundreds of millions of people around the world have access to computers connected to the Internet via Internet Service Providers (ISPs). Content providers (e.g., website owners or operators) place multimedia information (e.g., text, graphics, audio, video, animation, and other forms of data) at specific locations on the Internet referred to as webpages. Websites comprise a collection of connected, or otherwise related, webpages. The combination of all the websites and their corresponding webpages on the Internet is generally known as the World Wide Web (WWW) or simply the Web.

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

The flowchart and block diagrams in the figures illustrate the architecture, functionality, and operation of possible implementations of systems, methods and computer program products according to various embodiments. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

Further, although process steps, method steps, algorithms or the like may be described in a sequential order, such processes, methods and algorithms may be configured to work in alternate orders. In other words, any sequence or order of steps that may be described does not necessarily indicate a requirement that the steps be performed in that order. The steps of processes described herein may be performed in any order practical. Further, some steps may be performed simultaneously.

It will be readily apparent that the various methods and algorithms described herein may be implemented by, e.g., appropriately programmed general purpose computers and computing devices. Typically a processor (e.g., a microprocessor) will receive instructions from a memory or like device, and execute those instructions, thereby performing a process defined by those instructions. Further, programs that implement such methods and algorithms may be stored and transmitted using a variety of known media.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

The functionality and/or the features of a device may be alternatively embodied by one or more other devices which are not explicitly described as having such functionality/features. Thus, other embodiments of the present invention need not include the device itself.

The term "computer-readable medium" as used herein refers to any medium that participates in providing data (e.g., instructions) which may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory (DRAM), which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols, such as Bluetooth, TDMA, CDMA, 3G.

Where databases are described, it will be understood by one of ordinary skill in the art that (i) alternative database structures to those described may be readily employed, (ii) other memory structures besides databases may be readily employed. Any schematic illustrations and accompanying descriptions of any sample databases presented herein are exemplary arrangements for stored representations of information. Any number of other arrangements may be employed besides those suggested by the tables shown. Similarly, any illustrated entries of the databases represent exemplary information only; those skilled in the art will understand that the number and content of the entries can be different from those illustrated herein. Further, despite any depiction of the databases as tables, an object-based model could be used to store and manipulate the data types of the present invention and likewise, object methods or behaviors can be used to implement the processes of the present invention.

A "computer system" may refer to a system having one or more computers, where each computer may include a computer-readable medium embodying software to operate the computer or one or more of its components. Examples of a computer system may include: a distributed computer system for processing information via computer systems linked by a network; two or more computer systems connected together via a network for transmitting and/or receiving information between the computer systems; a computer system including two or more processors within a single computer; and one or more apparatuses and/or one or more systems that may accept data, may process data in accordance with one or more stored software programs, may generate results, and typically may include input, output, storage, arithmetic, logic, and control units.

A "network" may refer to a number of computers and associated devices that may be connected by communication facilities. A network may involve permanent connections such as cables or temporary connections such as those made through telephone or other communication links. A network may further include hard-wired connections (e.g., coaxial cable, twisted pair, optical fiber, waveguides, etc.) and/or wireless connections (e.g., radio frequency waveforms, free-space optical waveforms, acoustic waveforms, etc.). Examples of a network may include: an internet, such as the Internet; an intranet; a local area network (LAN); a wide area network (WAN); and a combination of networks, such as an internet and an intranet.

As used herein, the "client-side" application should be broadly construed to refer to an application, a page associated with that application, or some other resource or function invoked by a client-side request to the application. A "browser" as used herein is not intended to refer to any specific browser (e.g., Internet Explorer, Safari, FireFox, or the like), but should be broadly construed to refer to any client-side rendering engine that can access and display Internet-accessible resources. A "rich" client typically refers to a non-HTTP based client-side application, such as an SSH or CFIS client. Further, while typically the client-server interactions occur using HTTP, this is not a limitation either. The client server interaction may be formatted to conform to the Simple Object Access Protocol (SOAP) and travel over HTTP (over the public Internet), FTP, or any other reliable transport mechanism (such as IBM® MQSeries® technologies and CORBA, for transport over an enterprise intranet) may be used. Any application or functionality described herein may be implemented as native code, by providing hooks into another application, by facilitating use of the mechanism as a plug-in, by linking to the mechanism, and the like.

Exemplary networks may operate with any of a number of protocols, such as Internet protocol (IP), asynchronous transfer mode (ATM), and/or synchronous optical network (SONET), user datagram protocol (UDP), IEEE 802.x, etc.

Embodiments of the present invention may include apparatuses for performing the operations disclosed herein. An apparatus may be specially constructed for the desired purposes, or it may comprise a general-purpose device selectively activated or reconfigured by a program stored in the device.

Embodiments of the invention may also be implemented in one or a combination of hardware, firmware, and software. They may be implemented as instructions stored on a machine-readable medium, which may be read and executed by a computing platform to perform the operations described herein.

More specifically, as will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

In the following description and claims, the terms "computer program medium" and "computer readable medium" may be used to generally refer to media such as, but not limited to, removable storage drives, a hard disk installed in hard disk drive, and the like. These computer program products may provide software to a computer system. Embodiments of the invention may be directed to such computer program products.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Unless specifically stated otherwise, and as may be apparent from the following description and claims, it should be appreciated that throughout the specification descriptions utilizing terms such as "processing," "computing," "calculating," "determining," or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

In a similar manner, the term "processor" may refer to any device or portion of a device that processes electronic data from registers and/or memory to transform that electronic data into other electronic data that may be stored in registers and/or memory. A "computing platform" may comprise one or more processors.

Embodiments within the scope of the present disclosure may also include tangible and/or non-transitory computer-readable storage media for carrying or having computer-executable instructions or data structures stored thereon. Such non-transitory computer-readable storage media can be any available media that can be accessed by a general purpose or special purpose computer, including the functional design of any special purpose processor as discussed above. By way of example, and not limitation, such non-transitory computer-readable media can include RAM, ROM, EEPROM, CD-ROM or other optical disk storage, magnetic disk storage or other magnetic storage devices, or any other medium which can be used to carry or store desired program code means in the form of computer-executable instructions, data structures, or processor chip design. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

While a non-transitory computer readable medium includes, but is not limited to, a hard drive, compact disc, flash memory, volatile memory, random access memory, magnetic memory, optical memory, semiconductor based memory, phase change memory, optical memory, periodically refreshed memory, and the like; the non-transitory computer readable medium, however, does not include a pure transitory signal per se; i.e., where the medium itself is transitory.

The present invention will now be described in detail with reference to embodiments thereof as illustrated in the accompanying drawings.

There are various types of container assemblies that may be provided by preferred embodiments of the present invention. In one embodiment of the present invention, the container assembly may include a container that stores at least one item, and detects events to trigger actions. The container assembly may incorporate at least one sensor to detect events that occur in proximity to the container assembly. The at least one sensor may detect an eclectic assortment of events, including, without limitation, light, motion, temperature, magnetic fields, gravity, humidity, moisture, vibration, pressure, electrical fields, sound, radiation levels, and other physical aspects of the external environment. In some embodiments, the at least one sensor may detect the event and then transmit a signal to a measuring or control instrument to trigger a predetermined illumination, audio signal, and movement. Each sensor may be artistically coordinated with a style, dimension, and color of the container to produce a specific theme or functionality. In some embodiments, the container may be configured to simultaneously receive and store at least one item while projecting illuminating, moving, and generating audio signals. The container assembly may include an open end where the at least one item may access or be removed from the container. Those skilled in the art, in light of the present teachings, will recognize that certain sensors may be more functional in proximity to the open end of the container, where events may be more fully realized by the at least one sensor. The container may include, without limitation, a Halloween Trick-or-Treat Basket, a Christmas Basket, a Valentine's Day basket, an Easter basket, a piggy bank, and a tip jar. In yet another embodiment, the container may further include, without limitation, lunch pail, cornucopia basket, floral basket, caldron, regular bucket, and vase.

In one embodiment of the present invention, the container assembly may include at least one sensor to detect events. The at least one sensor may detect myriad events, including, without limitation, light, motion, temperature, magnetic fields, gravity, humidity, moisture, vibration, pressure, electrical fields, sound, and other physical aspects of the external environment. Each sensor may be strategically positioned on a section of the container efficacious for producing the desired result. For example, without limitation, a thermal sensor may position in proximity to the open end of a Halloween Trick-or-Treat basket to detect abrupt changes in temperature that occur near the open end, where candy is deposited. The basket may then illuminate and generate traditional scary Halloween noises to reward a candy giver. In yet another example, a motion sensor may position near a bottom end of the container to detect movement of the Halloween basket. Upon movement, the motion sensor may then trigger an illumination to enhance security and visibility for a child who is trick-or-treating at night.

In one embodiment of the present invention, the container assembly may include an illumination portion for emitting light. The illumination portion may include a plurality of light emitting diodes joined on a single strand. In this manner, space and energy may be conserved. The container assembly may further include an audio portion for emitting preprogrammed audio signals. The audio signals may include, without limitation, ghoulish laughter, screaming, holiday music, and salutations. The audio portion may include a speaker and a mute switch to regulate volume. The container assembly may include a processor portion for regulating the at least one sensor, illumination portion, audio portion, and various switches. The processor portion may include sufficient circuitry for memory and distribution of power. In some embodiments, a power switch may power on and off the electrical components of the container assembly.

FIG. 1 illustrates a detailed perspective view of an exemplary container assembly containing at least one item, in accordance with an embodiment of the present invention. In the present invention, a container assembly 100 may receive and store at least one item 102 while simultaneously generating themed illuminations, movements, and audio signals in response to events. At least one sensor may include a mechanical device sensitive to events, including, without limitation, light, motion, temperature, magnetic fields, gravity, humidity, moisture, vibration, pressure, electrical fields, sound, radiation levels, and other physical aspects of the external environment. After detecting the event, the at least one sensor may transmit a signal to a measuring or control instrument to trigger a predetermined illumination, audio signal, and movement. In some embodiments, the at least one item may include, without limitation, candy, hands, shadows, flowers, gifts, hardware, plants, liquids, and food. In some embodiments, the container assembly may include an open end where the at least one item may access or be removed from the container. In some embodiments, the container assembly may incorporate at least one sensor to detect the events that occur in proximity to the open end. Those skilled in the art, in light of the present teachings, will recognize that certain sensors may be more functional in proximity to the open end of the container assembly, where events may be more fully realized by the at least one sensor. Suitable materials for fabricating the container assembly may include, without limitation, polyvinyl chloride, polystyrene, polyethylene terephthalate, paperboard, paper, plastic film, glass, foam, porcelain, wood, clay and various fibers. In some embodiments, the bottom section of the container assembly may be recessed with the purpose of protecting the processor portion, circuit, microchip, at least one sensor, and audio portion from direct contact with any surface. An extended border of the container that allows this recession may be of various lengths, depending on the size and dimensions of the processor portion, sensors, and illumination portion. In one embodiment, the container assembly may be sized and dimensioned, without limitation, a 26" circumference, an 8" depth, a 9" diameter, a 5" open end, and a 5" base portion. However, in other embodiments, the container assembly may be sized larger or smaller, depending on needs of a user.

Figure 2:
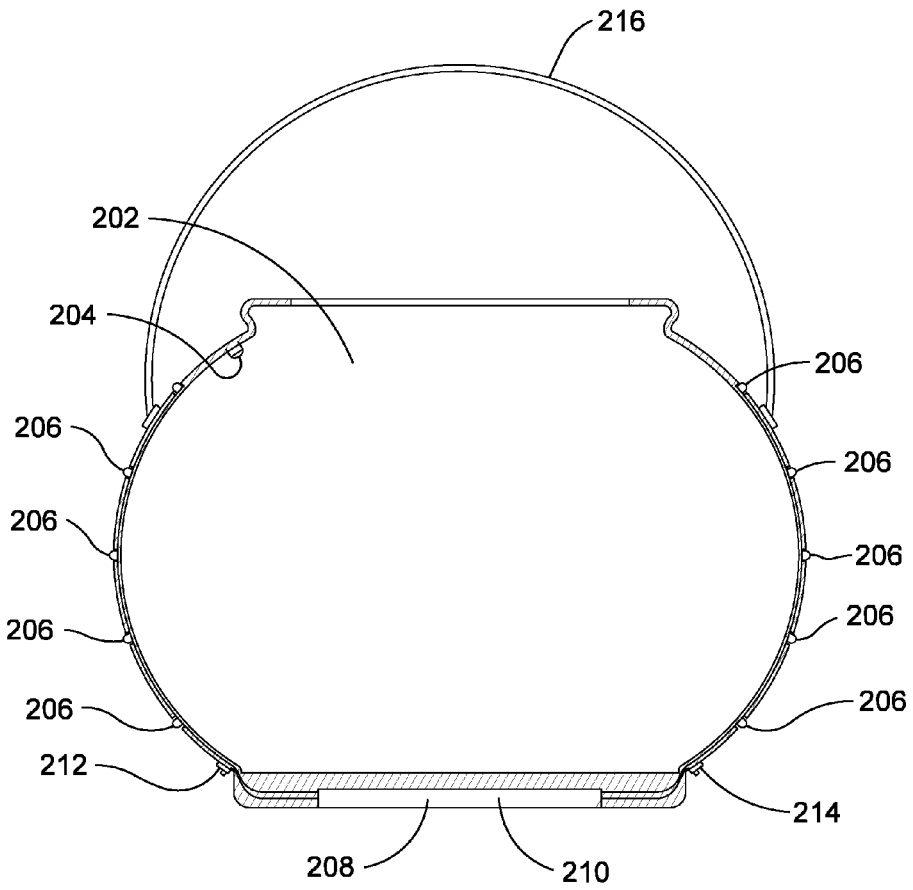
FIG. 2 illustrates a sectioned view of an exemplary container assembly, in accordance with an embodiment of the present invention.

FIG. 2 illustrates a sectioned view of an exemplary container assembly, in accordance with an embodiment of the present invention. In the present invention, the container assembly may include at least one sensor 204 to detect events. The at least one sensor may detect myriad events, including, without limitation, light, shadows, motion, temperature, magnetic fields, gravity, humidity, moisture, vibration, pressure, weight, electrical fields, sound, and other physical aspects of the external environment. Each sensor may be strategically positioned on a section of the container assembly efficacious for producing the desired result. For example, without limitation, a thermal portion may position in proximity to an open end 202 of the container assembly, whereby a hand may be detected. The container assembly may then actuate the appropriate illumination, movement, or audio signal. In yet another example, a weight sensor may detect the amount of candy in a Halloween Trick-or-Treat Basket and activate when the candy inside reaches a predetermined weight. In one alternative embodiment, the at least one sensor may be programmed to transmit a signal to a remote processor, for example, to alert a parent that the Halloween Basket has reached the predetermined weight. In some embodiments, the at least one sensor may position inside the container assembly, while the illumination portion integrates into the body of the container assembly, and the audio portion may position outside the container assembly at a base portion. However, in other embodiments, each component may position in a plurality of different positions on the container assembly.

In one embodiment of the present invention, the at least one sensor may include a thermal sensor for detecting variances in temperature in proximity to the container assembly. The thermal sensor may include a passive infrared sensor. Those skilled in the art, in light of the present teachings, will recognize that the passive infrared sensor may include a pyroelectric device that detects motion by measuring changes in the infrared heat levels emitted by surrounding objects, such as a human hand. In some embodiments, when motion is detected, the passive infrared sensor may output a high signal on an output pin. This logic signal may be read by the processor portion and used to drive an external load. In some embodiments, the passive infrared sensor may include various features efficacious for detecting an event and providing the appropriate trigger, including, without limitation, detecting a person up to 30 feet away, or up to 15 feet away in reduced sensitivity mode, including a jumper that selects normal operation or reduced sensitivity, a source current that runs 12 mA @ 3 Volts up to 23 mA @ 5 Volts; onboard light emitting diodes that light up a lens for fast visual feedback when movement is detected; mounting holes for 2-56 sized screws; 3-pin SIP header ready for breadboard or through-hole projects; a small size for facilitated concealment; and easy interface to a microcontroller or the processor portion.

In one embodiment of the present invention, the at least one sensor may include a light sensor. The light sensor may include a photocell. The photocell may include Cadmium-Sulfide cells, light-dependent resistors, and photoresistors. Those skilled in the art, in light of the present teachings, will recognize that photocells may include a resistor that changes a resistive value, in ohms Ω, depending on how much light is shining onto a face portion. Those skilled in the art, in light of the present teachings, will recognize that the photocell may be utilized chiefly to determine basic light changes, such as hands passing in proximity to the open end of the container assembly. In some embodiments, the photocell may include various features efficacious for detecting an event and providing the appropriate trigger, including, without limitation, round shapes; 5 mm up to 12 mm diameter; resistive changes ranging from 200 KΩ (dark) to 10 KΩ (10 lux brightness); sensitivity ranges to light between 400 nm (violet) and 600 nm (orange) wavelengths; peaking at about 520 nm (green); and a power supply up to 100 Volts.

In one embodiment of the present invention, the at least one sensor may include a motion sensor. The motion sensor may include a tilt sensors configured to detect orientation or inclination of the container assembly. The tilt sensor may include, without limitation, mercury switches, tilt switches, and rolling ball sensors. In some embodiments, the tilt sensor may include a cavity with a conductive free mass inside, such as a blob of mercury or rolling ball. One end of the cavity may include two conductive elements, or poles. When the tilt sensor orients so that one end orients downwards, the mass rolls onto the poles and shorts them, acting as a switch throw.

In some embodiments, the tilt sensor may include various features efficacious for detecting an event and providing the appropriate trigger, including, without limitation, a cylinder with 4 mm diameter and 12 mm length; a sensitivity range greater than fifteen degrees; a lifetime of 50,000 cycles; and a power supply up to 24 Volts. In one embodiment, the motion sensor may include an SQ-ASD omni-directional shock and acceleration sensor. The SQ-ASD omni-directional shock and acceleration sensor may include an open device configured to be sensitive in a plurality of directions. In some embodiments, the sensor may trigger radially or in the terminal 1→2 direction when acceleration is applied. In the terminal 2→1 direction, the sensor may trigger after the acceleration is removed. Those skilled in the art, in light of the present teachings, will recognize that if using the rebound trigger in the 2→1 direction is not appropriate for the application, two sensors may be mounted parallel to each other in opposite directions in the container assembly. In one embodiment, the motion sensor may include an SQ-MIN-200 sensor that is configured to operate like a normally closed switch which chatters open and closed when tilted or vibrated. Those skilled in the art, in light of the present teachings, will recognize that unlike other rolling-ball sensors, the SQ-MIN-200 sensor may include an omnidirectional movement sensor that is operable regardless of the orientation it is mounted or aligned. In yet another embodiment, a vibration sensor may use a spring or a tilt switch to activate the illumination portion.

In one embodiment of the present invention, the container assembly may include an illumination portion 206 for emitting light from the container assembly. The illumination portion may include a plurality of light emitting diodes joined on a single strand. In this manner, space and energy may be conserved. However, in other embodiments, the illumination portion may include, without limitation, fiber optic lights, incandescent lamps, gas discharge lamps, and chemical lamps. In some embodiments, an illumination switch 214 may regulate the activation and luminance of the illumination portion. The container assembly may further include an audio portion 210 for emitting preprogrammed audio signals. The audio portion may include a speaker and an audio switch 212 to regulate volume and a mute function. In some embodiments, the container assembly may include a processor portion 208 for regulating the at least one sensor, illumination portion, audio portion, and switches. The processor portion may include sufficient circuitry for memory and distribution of power. In some embodiments, a power switch 212 may power on and off the electrical components of the container assembly. A handle portion 216 may join with the container assembly to provide a grip for transporting the container assembly.

Figure 3:
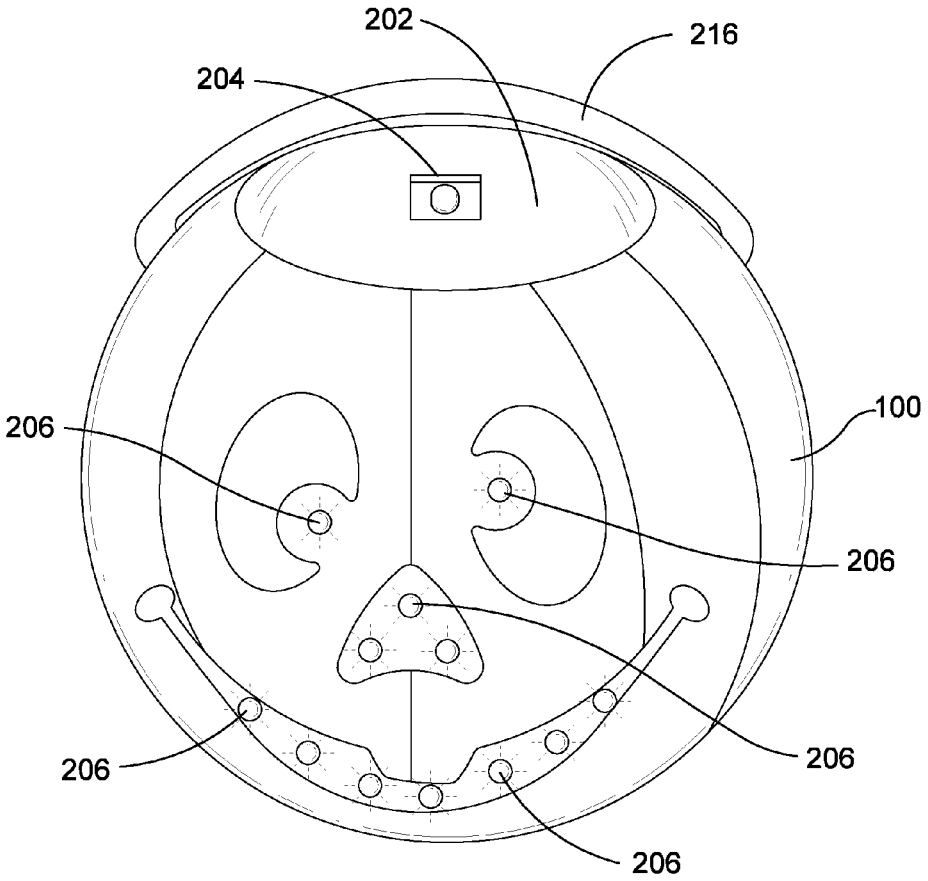
FIG. 3 illustrates a detailed perspective view of an exemplary at least one sensor positioned inside an exemplary container assembly, in accordance with an embodiment of the present invention.

FIG. 3 illustrates a detailed perspective view of an exemplary at least one sensor positioned inside an exemplary container assembly, in accordance with an embodiment of the present invention. In the present invention, the at least one sensor may detect myriad events, including, without limitation, light, motion, temperature, magnetic fields, gravity, humidity, moisture, vibration, pressure, electrical fields, sound, and other physical aspects of the external environment. The events may be generated by the actions of people or animals in proximity to the container assembly.

Figure 4:
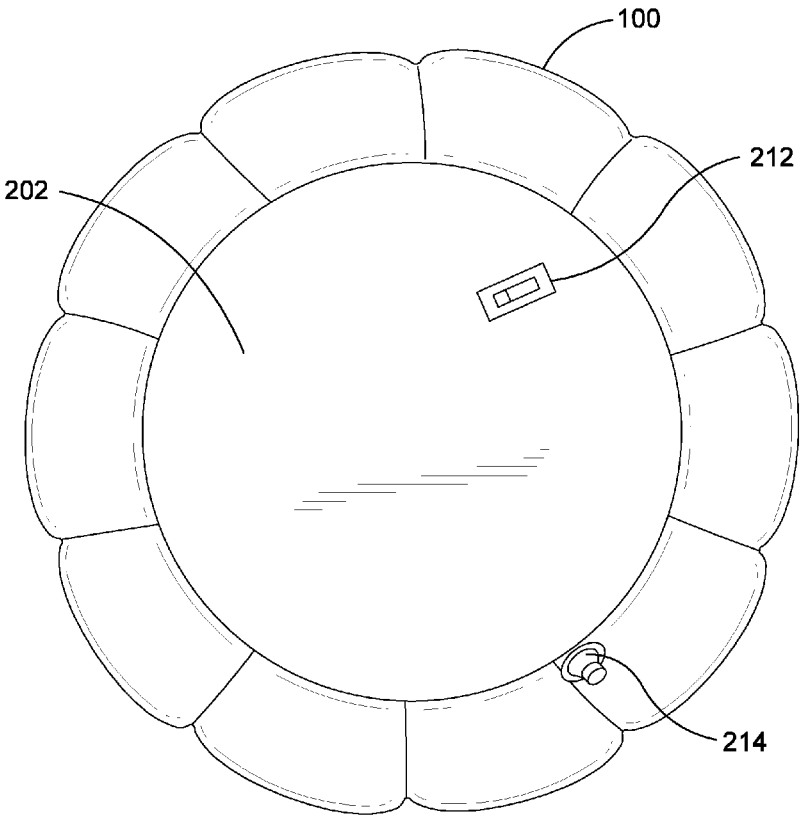
FIG. 4 illustrates a detailed perspective view of an exemplary audio portion positioned inside an exemplary container assembly, in accordance with an embodiment of the present invention.

FIG. 4 illustrates a detailed perspective view of an exemplary audio portion positioned inside an exemplary container assembly, in accordance with an embodiment of the present invention. In the present invention, the container assembly may include an audio portion for emitting preprogrammed audio signals. The audio portion may include a speaker and an audio switch to regulate volume. The audio portion may further include perforated speakers. The container assembly may include a processor portion for regulating the at least one sensor, illumination portion, audio portion, and switches. In some embodiments, the audio portion may include an audio switch and an illumination switch that allow a user to use both lights and sound or just lights or just sound. In some embodiments, the audio switch may include, without limitation, loud, soft and off settings. In one embodiment, the processor portion may include circuitry contained within an enclosed recession in direct proximity to a power source compartment. The light emitting diodes of the illumination portion may join with the circuitry. The circuitry may include one resistor connected by wire to each of the light-emitting diodes. In some embodiments, the resistor may join by wire to the processor portion, stored within the memory of which is an audio recording associated with Halloween, including, without limitation, a scary sound. In some embodiments, a speaker may be sized and dimensioned ½" diameter. The speaker may broadcast at an approximate volume of forty decibels. The speaker may position on the base portion of the container assembly and broadcasts through perforations on the base portion of the container assembly. In some embodiments, the audio portion may emit an eclectic assortment of sounds, including, without limitation, sound effects, personal recordings, voice recordings, scary sounds, friendly sounds, jingles, songs, bells, whistles, and big band.

Figure 5:
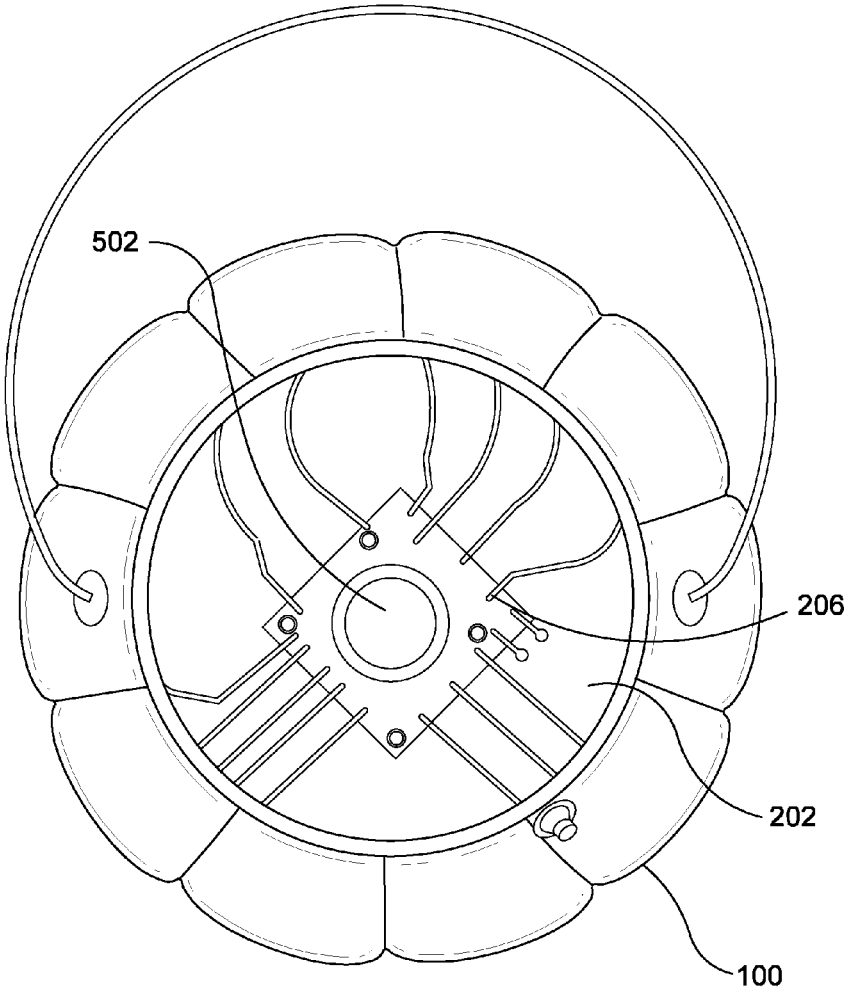
FIG. 5 illustrates a detailed perspective view of an exemplary motion sensor and an exemplary processor portion positioned inside an exemplary container assembly, in accordance with an embodiment of the present invention.

FIG. 5 illustrates a detailed perspective view of an exemplary motion sensor and an exemplary processor portion positioned inside an exemplary container assembly, in accordance with an embodiment of the present invention. In the present invention, the motion sensor may detect various movements, including, without limitation, shock, tilt, impact, vibration, motion and acceleration. The motion sensor may be incorporated into a plastic shell that composes the container assembly. In some embodiments, the sensitivity of the motion sensor may be adjusted. For example, without limitation, container assembly may be set to activate on a user's hand movement of the basket. Depending on circuit configuration the motion sensor may trigger solely the light emitting diodes, or both the light emitting diodes and the audio signal simultaneously.

Figure 6:
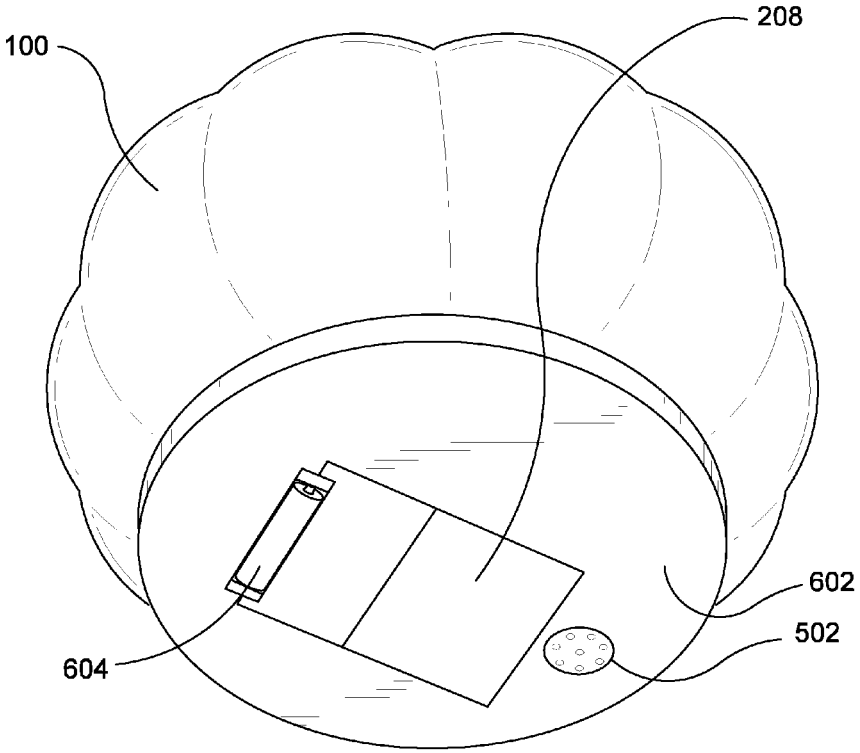
FIG. 6 illustrates a detailed perspective view of an exemplary audio portion and an exemplary processor portion positioned outside an exemplary container assembly, in accordance with an embodiment of the present invention.

FIG. 6 illustrates a detailed perspective view of an exemplary audio portion and an exemplary processor portion embedded in a shell of the container assembly, in accordance with an embodiment of the present invention. In the present invention, the audio portion may be recessed inside a base portion 602 of the container assembly. In this manner, the at least one item may not restrict the audio signals while the container assembly is being carried. A power source 604 may provide the power to operate the audio portion. The power source may include, without limitation, a battery, an external power source, and a solar panel. The processor portion may regulate the audio portion and coordinate the audio signals to actuate with the illumination portion.

Figure 7A:
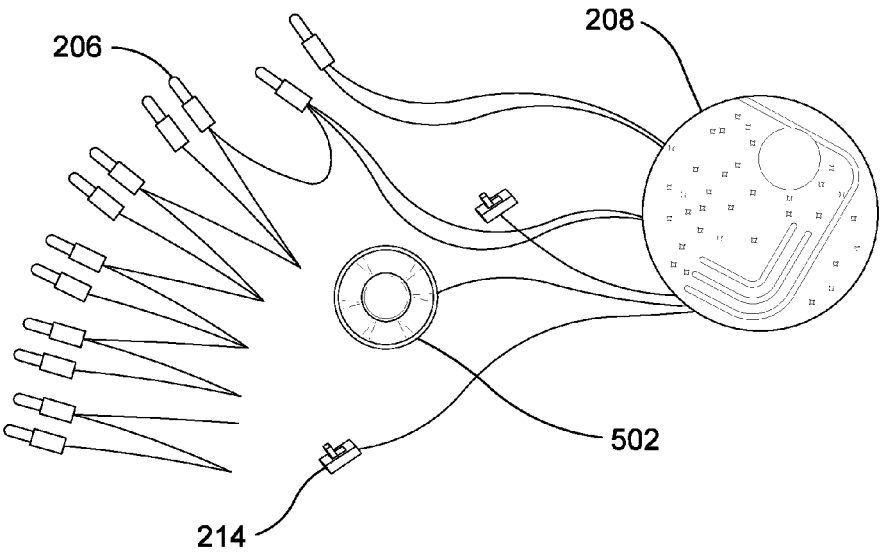
FIGS. 7A and 7B illustrate top views of an exemplary processor portion and an exemplary illumination portion, where
Figure 7B:
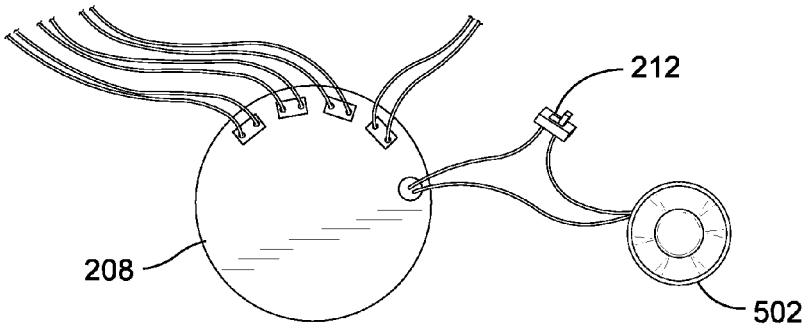

FIGS. 7A and 7B illustrate top views of an exemplary processor portion and an exemplary illumination portion, where FIG. 7A illustrates a front side of an exemplary processor portion, and FIG. 7B illustrates a back side of an exemplary processor portion with an exemplary audio power switch, in accordance with an embodiment of the present invention. In the present invention, the container assembly may include a processor portion that controls the electronic components of the container assembly. The processor portion may include, without limitation, an integrated circuit, a computer chip, and a processor chip. The processor portion may utilize wires to integrate the at least one sensor with the illumination portion, the audio portion, the various switches, and the power source. In some embodiments, the illumination portion may include a string of 16 light emitting diodes having a plurality of different colors. The light emitting diode wire may be 12" in length. However, in other embodiments, other lengths may be utilized. In some embodiments, the illumination portion may include both a consistent and timed-flash emission when the power is activated by the illumination switch.

In one alternative embodiment, the container assembly may include a camera that may be viewed from a remote display or on the internet. In this manner, parents may monitor children during Halloween trick-or-treating activities. In yet another alternative embodiment, the container assembly may include a self-destruct mode when an unauthorized item is deposited inside the at least one container and triggers the at least one sensor. The self-destruct mode may be utilized in military operations. In yet another alternative embodiment, the processor portion may regulate a smart phone integrated into the container assembly. The smart phone may be operable to communicate with other phones or computers. In yet another alternative embodiment, a plurality of container assemblies may coordinate to trigger their illumination portion and audio portion simultaneously. However, the plurality of container assemblies may further be programmed to emit an alert if separated beyond a predetermined range. In yet another alternative embodiment, documents may be placed inside the container assembly and a scanner may read the text to trigger an appropriate light or sound for each document.

Figure 8:
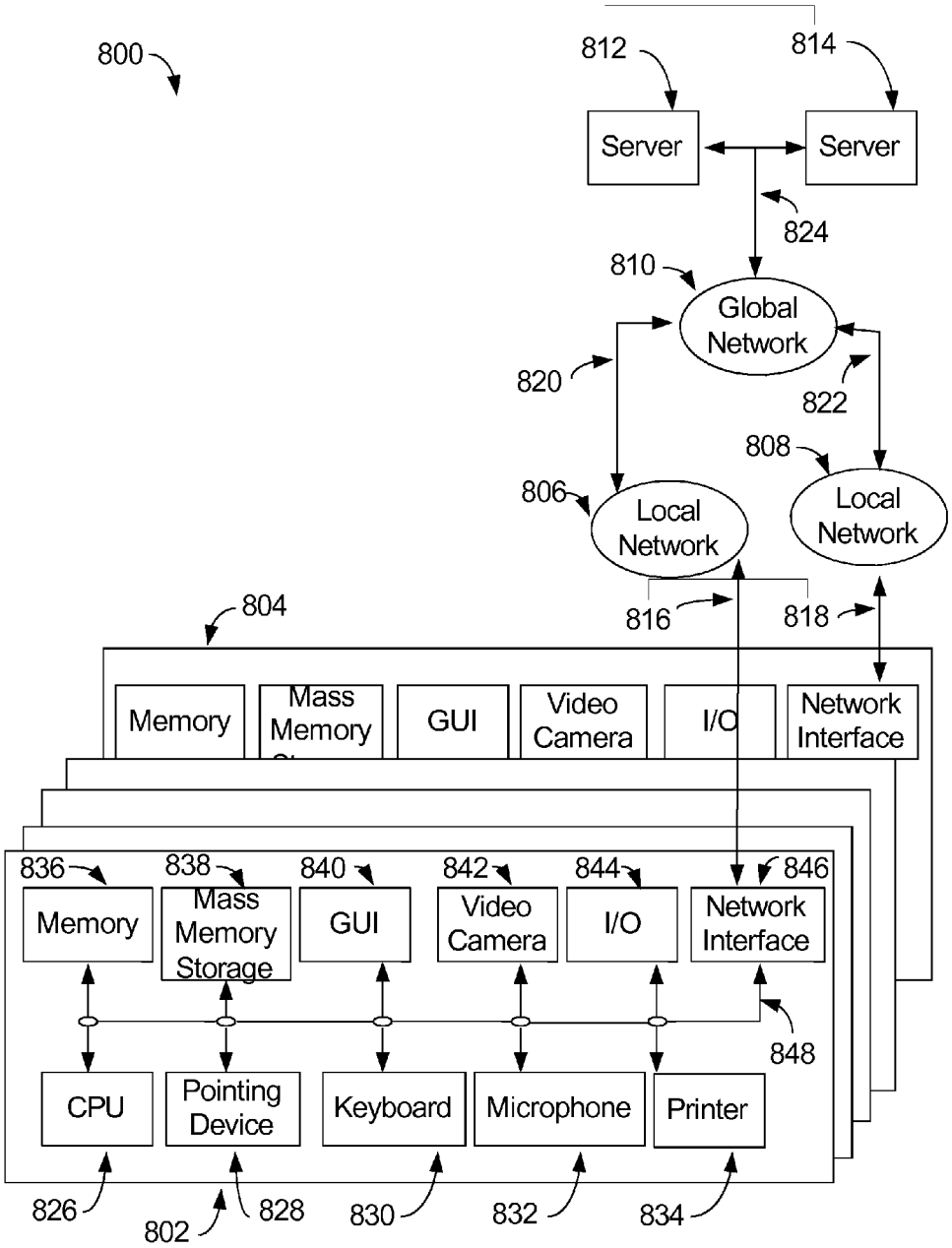
FIG. 8 illustrates a typical computer system that, when appropriately configured or designed, can serve as an exemplary method for identification, in accordance with an embodiment of the present invention.

FIG. 8 illustrates a typical computer system that, when appropriately configured or designed, can serve as an exemplary method for detecting events from a container assembly, in accordance with an embodiment of the present invention. In the present invention, a communication system 800 includes a multiplicity of clients with a sampling of clients denoted as a client 802 and a client 804, a multiplicity of local networks with a sampling of networks denoted as a local network 806 and a local network 808, a global network 810 and a multiplicity of servers with a sampling of servers denoted as a server 812 and a server 814.

Client 802 may communicate bi-directionally with local network 806 via a communication channel 816. Client 804 may communicate bi-directionally with local network 808 via a communication channel 818. Local network 806 may communicate bi-directionally with global network 810 via a communication channel 820. Local network 808 may communicate bi-directionally with global network 810 via a communication channel 822. Global network 810 may communicate bi-directionally with server 812 and server 814 via a communication channel 824. Server 812 and server 814 may communicate bi-directionally with each other via communication channel 824. Furthermore, clients 802, 804, local networks 806, 808, global network 810 and servers 812, 814 may each communicate bi-directionally with each other.

In one embodiment, global network 810 may operate as the Internet. It will be understood by those skilled in the art that communication system 800 may take many different forms. Non-limiting examples of forms for communication system 800 include local area networks (LANs), wide area networks (WANs), wired telephone networks, wireless networks, or any other network supporting data communication between respective entities.

Clients 802 and 804 may take many different forms. Non-limiting examples of clients 802 and 804 include personal computers, personal digital assistants (PDAs), cellular phones and smartphones.

Client 802 includes a CPU 826, a pointing device 828, a keyboard 830, a microphone 832, a printer 834, a memory 836, a mass memory storage 838, a GUI 840, a video camera 842, an input/output interface 844 and a network interface 846.

CPU 826, pointing device 828, keyboard 830, microphone 832, printer 834, memory 836, mass memory storage 838, GUI 840, video camera 842, input/output interface 844 and network interface 846 may communicate in a unidirectional manner or a bi-directional manner with each other via a communication channel 848. Communication channel 848 may be configured as a single communication channel or a multiplicity of communication channels.

CPU 826 may be comprised of a single processor or multiple processors. CPU 826 may be of various types including micro-controllers (e.g., with embedded RAM/ROM) and microprocessors such as programmable devices (e.g., RISC or SISC based, or CPLDs and FPGAs) and devices not capable of being programmed such as gate array ASICs (Application Specific Integrated Circuits) or general purpose microprocessors.

As is well known in the art, memory 836 is used typically to transfer data and instructions to CPU 826 in a bi-directional manner. Memory 836, as discussed previously, may include any suitable computer-readable media, intended for data storage, such as those described above excluding any wired or wireless transmissions unless specifically noted. Mass memory storage 838 may also be coupled bi-directionally to CPU 826 and provides additional data storage capacity and may include any of the computer-readable media described above. Mass memory storage 838 may be used to store programs, data and the like and is typically a secondary storage medium such as a hard disk. It will be appreciated that the information retained within mass memory storage 838, may, in appropriate cases, be incorporated in standard fashion as part of memory 836 as virtual memory.

CPU 826 may be coupled to GUI 840. GUI 840 enables a user to view the operation of computer operating system and software. CPU 826 may be coupled to pointing device 828. Non-limiting examples of pointing device 828 include computer mouse, trackball and touchpad. Pointing device 828 enables a user with the capability to maneuver a computer cursor about the viewing area of GUI 840 and select areas or features in the viewing area of GUI 840. CPU 826 may be coupled to keyboard 830. Keyboard 830 enables a user with the capability to input alphanumeric textual information to CPU 826. CPU 826 may be coupled to microphone 832. Microphone 832 enables audio produced by a user to be recorded, processed and communicated by CPU 826. CPU 826 may be connected to printer 834. Printer 834 enables a user with the capability to print information to a sheet of paper. CPU 826 may be connected to video camera 842. Video camera 842 enables video produced or captured by user to be recorded, processed and communicated by CPU 826.

CPU 826 may also be coupled to input/output interface 844 that connects to one or more input/output devices such as such as CD-ROM, video monitors, track balls, mice, keyboards, microphones, touch-sensitive displays, transducer card readers, magnetic or paper tape readers, tablets, styluses, voice or handwriting recognizers, or other well-known input devices such as, of course, other computers.

Finally, CPU 826 optionally may be coupled to network interface 846 which enables communication with an external device such as a database or a computer or telecommunications or internet network using an external connection shown generally as communication channel 816, which may be implemented as a hardwired or wireless communications link using suitable conventional technologies. With such a connection, CPU 826 might receive information from the network, or might output information to a network in the course of performing the method steps described in the teachings of the present invention.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

All the features or embodiment components disclosed in this specification, including any accompanying abstract and drawings, unless expressly stated otherwise, may be replaced by alternative features or components serving the same, equivalent or similar purpose as known by those skilled in the art to achieve the same, equivalent, suitable, or similar results by such alternative feature(s) or component(s) providing a similar function by virtue of their having known suitable properties for the intended purpose. Thus, unless expressly stated otherwise, each feature disclosed is one example only of a generic series of equivalent, or suitable, or similar features known or knowable to those skilled in the art without requiring undue experimentation.

Having fully described at least one embodiment of the present invention, other equivalent or alternative methods of implementing a container that detects events that trigger themed lights and sound according to the present invention will be apparent to those skilled in the art. Various aspects of the invention have been described above by way of illustration, and the specific embodiments disclosed are not intended to limit the invention to the particular forms disclosed. The particular implementation of the container that detects events that trigger themed lights and sound may vary depending upon the particular context or application. By way of example, and not limitation, the container that detects events that trigger themed lights and sound described in the foregoing were principally directed to a Halloween Trick-or-Treat basket that lights up when candy is put inside implementations; however, similar techniques may instead be applied to desk drawers that make noise when particular files are put inside, as a scanner reads the text of the paperwork, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. An assembly comprising:

a container, said container being configured to store at least one item;

at least one sensor, said at least one sensor being disposed to join with said container, said at least one sensor being configured to at least partially detect at least one event in proximity to said container, said at least one sensor being operable to communicate an indication of said at least one event, said at least one sensor comprising a motion sensor, said motion sensor being operable to at least partially detect motion and communicate an indication of said motion, said at least one sensor further comprising a thermal sensor, said thermal sensor being operable to at least partially detect thermal energy and communicate an indication of said thermal energy, said at least one sensor further comprising an illumination sensor, said illumination sensor being operable to at least partially detect illumination and communicate an indication of said illumination;

an illumination portion, said illumination portion being operable to emit an illumination in response to said at least one event; and an audio portion, said audio portion being operable to emit an audio signal in response to said at least one event.

2. The assembly of claim 1, in which said container comprises a Halloween basket.

3. The assembly of claim 1, in which said container comprises an open end, said open end being configured to enable said at least one item to at least partially enter said container.

4. The assembly of claim 1, wherein said at least one sensor is operable to detect at least partial entry of said at least one item through said open end.

5. The assembly of claim 1, in which said at least one item comprises candy, and/or a hand, and/or a shadow.

6. The assembly of claim 1, in which said container comprises a handle portion, said handle portion being configured to help transport said container.

7. The assembly of claim 1, in which said container comprises a base portion, said base portion being configured to at least partially cover said at least one sensor, and/or said illumination portion, and/or said audio portion.

8. The assembly of claim 1, in which audio portion comprises a speaker, said speaker being configured to magnify said audio signal.

9. The assembly of claim 1, in which audio portion comprises an audio switch, said audio switch being configured to actuate said audio portion, said audio switch further being configured to at least partially suppress said audio signal.

10. The assembly of claim 1, in which said illumination portion comprises a plurality of light emitting diodes, said plurality of light emitting diodes being operable to emit light at least partially through said container, said plurality of light emitting diodes being disposed to position in a circular series for forming a jack-o-lantern face.

11. The assembly of claim 1, in which said illumination portion comprises an illumination switch, said illumination switch being configured to actuate said illumination portion, said illumination switch further being configured to at least partially suppress said illumination.

12. The assembly of claim 1, in which said thermal sensor comprises a passive infra-red sensor, said passive infra-red sensor being operable to at least partially detect slight variances in temperature.

13. The assembly of claim 1, in which said motion sensor comprises an omni directional tilt and vibration sensor, said omni directional tilt and vibration sensor being operable to at least partially detect vibrations, and/or tilting from a plurality of directions.

14. The assembly of claim 1, in which said illumination sensor comprises at least one photocell.

15. The assembly of claim 1, wherein said illumination portion, and/or said audio portion operatively join with said at least one sensor.

16. The assembly of claim 1, in which said assembly comprises a processor portion, said processor portion being configured to process detections and/or communications from said at least one sensor.

17. The assembly of claim 1, in which said assembly comprises a power switch, said power switch being configured to actuate said illumination portion, and/or said audio portion, and/or said at least one sensor.

18. The assembly of claim 1, in which said assembly comprises a power source, said power source comprising a battery.

19. A container comprising:

means for grasping a handle portion of a container;

means for positioning at least one item at least partially through an open end of said container;

means for detecting thermal energy and communicating an indication of said thermal energy from a thermal sensor;

means for tilting and/or vibrating said container;

means for detecting thermal motion and communicating an indication of said motion from a motion sensor;

means for illuminating said container with an illuminating portion; and means for generating an audio signal from an audio portion.

20. A container consisting of:

a container, said container comprising an open end, said container further comprising a handle portion, said container further comprising a base portion, said container being configured to store at least one item;

at least one sensor, said at least one sensor being disposed to join with said container, said at least one sensor being configured to at least partially detect at least one event in proximity to said container, said at least one sensor being operable to communicate an indication of said at least one event, said at least one sensor comprising a motion sensor, said motion sensor being operable to at least partially detect motion and communicate an indication of said motion, said motion sensor comprising an omni directional tilt and vibration sensor, said omni directional tilt and vibration sensor being operable to at least partially detect vibrations, and/or tilting from a plurality of directions, said at least one sensor further comprising a thermal sensor, said thermal sensor being operable to at least partially detect thermal energy and communicate an indication of said thermal energy, said thermal sensor comprising a passive infra-red sensor, said passive infra-red sensor being operable to at least partially detect slight variances in temperature, said at least one sensor further comprising an illumination sensor, said illumination sensor being operable to at least partially detect illumination and communicate an indication of said illumination, said illumination sensor comprising at least one photocell;

an illumination portion, said illumination portion being operable to emit an illumination in response to said at least one event, said illumination portion comprising a plurality of light emitting diodes, said plurality of light emitting diodes being operable to emit light at least partially through said container, said plurality of light emitting diodes being disposed to position in a circular series for forming a jack-o-lantern face, said illumination portion further comprising an illumination switch, said illumination switch being configured to actuate said illumination portion, said illumination switch further being configured to at least partially suppress said illumination;

an audio portion, said audio portion being operable to emit an audio signal in response to said at least one event, said audio portion comprising a speaker, said speaker being configured to magnify said audio signal, said audio portion further comprising an audio switch, said audio switch being configured to actuate said audio portion, said audio switch further being configured to at least partially suppress said audio signal;

a processor portion, said processor portion being configured to process detections and/or communications from said at least one sensor;

a power switch, said power switch being configured to actuate said illumination portion, and/or said audio portion, and/or said at least one sensor; and a power source, said power source comprising a battery.

* * * * *